United States Patent [19]

Eigenbrode

[11] 3,993,396

[45] Nov. 23, 1976

[54] CONNECTOR BLOCK

[75] Inventor: George Thomas Eigenbrode, Mechanicsburg, Pa.

[73] Assignee: E. I. Du Pont de Nemours and Company, Wilmington, Del.

[22] Filed: Jan. 12, 1976

[21] Appl. No.: 648,512

[52] U.S. Cl. ..... 339/220 R

[51] Int. Cl.[2] ..... H01R 13/40

[58] Field of Search ..... 339/59–61, 339/217, 220, 256, 258

[56] References Cited

UNITED STATES PATENTS 3,441,661 4/1969 Brummans ..... 339/217 S 3,693,134 9/1972 Trevisiol ..... 339/59 M

FOREIGN PATENTS OR APPLICATIONS 1,187,754 4/1970 United Kingdom ..... 339/220 R

*Primary Examiner*—Joseph H. McGlynn

[57] ABSTRACT

A rigid connector block formed of molded filled thermoplastic material having a row of open ended cavities with rigid locking tongues entending from an exterior wall into adjacent pairs of cavities, the tongues integrally joining the exterior wall and side walls between the pairs of cavities.

8 Claims, 12 Drawing Figures

CONNECTOR BLOCK

The invention relates to molded connector blocks for connectors or like articles where the connectors are inserted in cavities and are confined within the cavities by rigid integral locking tongues. The blocks of the invention are molded from rigid filled thermo-plastic material with a row of open ended cavities extending along one exterior wall of the block and separated by side walls. The exterior or top wall of the block includes tongue portions which overlie the cavity side walls and extending laterally of the side walls to overlie the adjacent cavities. These portions are broken away from the top wall on three sides and are forced into the cavities and underlying side wall to form rigid locking tongues integral with the side walls and exterior wall and extending into the cavities to block withdrawal of previously inserted connectors or articles. Grooves are provided on the periphery of the tongue portions to facilitate breaking away of the portions from the exterior wall during staking without cracking the rigid molded block.

The sides of a pair of staked tongues extend into each cavity in the block thus cooperating to confine the connectors or articles in the cavities. The rigid tongues are integrally bonded to the side walls and to the exterior wall and provide improved pull out resistance over flexible snap latches of the type well known in the Art. See U.S. Pats. Nos. 3,441,661, 3,517,370 and 3,781,760.

Other objects and features of the invention will become apparent as the description proceeds, especially when taken in conjunction with the accompanying drawings illustrating the invention, of which there is one sheet.

IN THE DRAWINGS

Figure 5:
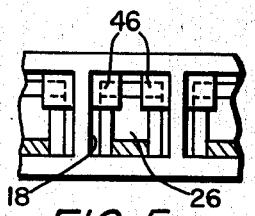
FIG. 5 is a view taken along line 5—5 of FIG. 4.
Figure 6:
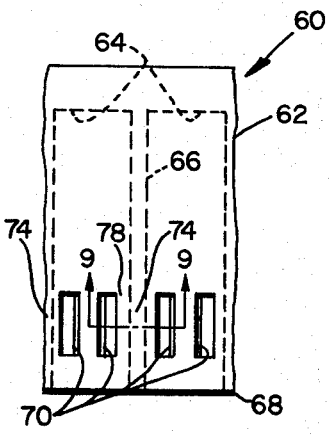
Figure 7:
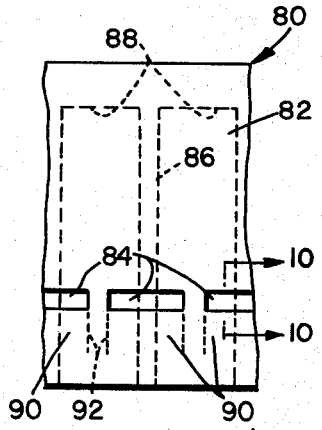
Figure 8:
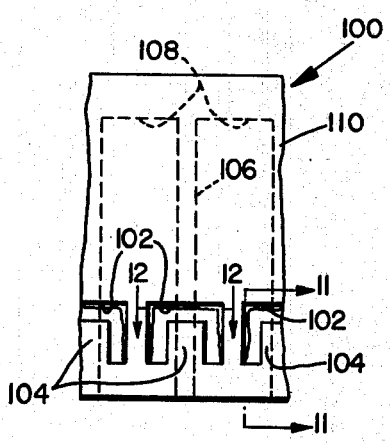
Figure 9:
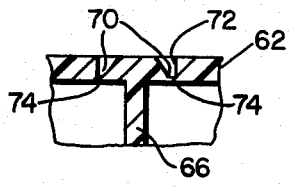

FIGS. 6, 7 and 8 are partially broken away top views of blocks similar to the block shown in FIGS. 1 through 5; and FIGS. 9, 10, 11 and 12 are sectional views taken respectively along lines 9—9, 10—10, 11—11, and 12—12 of FIGS. 6, 7 and 8.

Figure 3:
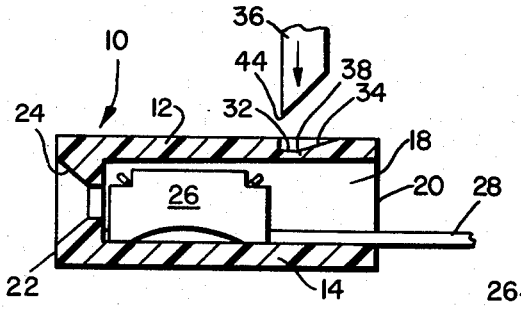
FIG. 3 is a sectional view taken along line 3—3 of FIG. 2 with a connector positioned in the block.
Figure 4:
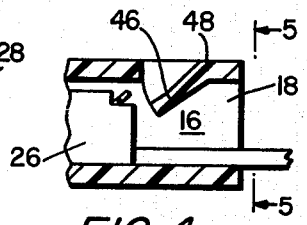
FIG. 4 is a fragmentary view similar to that of FIG. 3 following staking of the block to confine the connector in place.

Connector block 10 is molded from a rigid filled thermo-plastic material and includes a top or exterior wall 12, a bottom wall 14 and a number of spaced side walls 16 joining the top and bottom walls. Walls 12, 14 and 16 define a number of open ended cavities 18 extending into the block from edge 20. A lead receiving opening 24 extends from each cavity 18 through edge 22 to permit leads to be inserted into the cavities for engagement with connectors or terminals 26 moved into the cavities from block edge 20 as illustrated in FIG. 3. The connectors include integral tails 28 extending outwardly of the cavities from edge 20 for connection to a conductor as desired.

Figure 1:
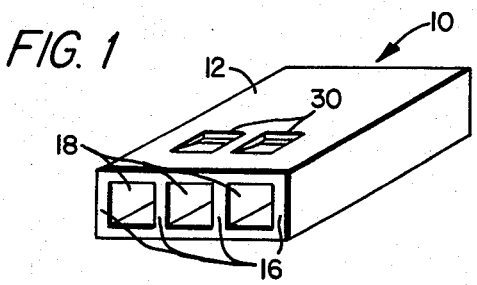
FIG. 1 is a prospective view of a connector block according to the invention.
Figure 2:
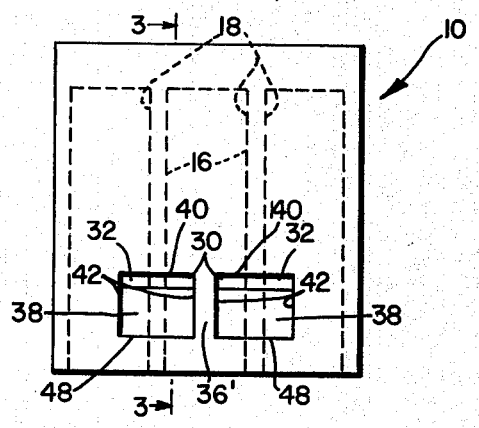
FIG. 2 is a top view of the block of FIG. 1.

As illustrated in FIG. 2, grooves or recesses 30 are formed in the exterior surface of top wall 12 above side walls 16. The grooves extend laterally of the side walls and overlie the adjacent cavities 18. Each groove includes a groove bottom 32 extending transversely of a side wall 16 and a surface 34 extending from bottom 32 toward block edge 20 at a shallow angle. A top wall portion 36 separates adjacent grooves.

Following loading of connectors 26 into cavities 18 as shown in FIG. 3, the block 10 is positioned on a support and individual staking tools 36 are lowered against the portions 38 of top wall 12 beneath shallow grooves 30 to sever the ends 40 and sides 42 of the portions from the top wall and move the portions down into the adjacent side walls 16 with the sides of the portions extending into the underlying cavities 18. See FIG. 4. Tools 36 are rectangular in transverse cross section, conforming to the rectangular shape of portions 38. The work end of the tool is chisel-shaped, having a cutting edge 44 extending along the groove bottom 32 so that upon lowering of the tool the edge severs end 40 of the tongue portion from the top wall. Continued downward movement of the tool severs the edges 42 from the top wall and moves the portion 38 down from the top wall into the interior of the block to form a rigid locking tongue 46 located in the path of withdrawal of connector 26 so as to confine the connector within the cavity. The tongue 46 is integral with the body at the junction with side wall 16 and at the junction with top wall 12 at base 48. While there are only three cavities in block 10 it is contemplated that blocks according to the invention may have a series of cavities so that after connectors are loaded into the cavities and the tongue portions are staked a pair of tongues extend into each cavity except the end cavities.

Connector block 10 is molded from a thermo-plastic material preferably filled with glass fibers, although other filling material may be used. The filling material imparts rigidity to the molded block. During staking of locking tongues 46 to confine the connectors in recesses 18 sufficient energy is imparted to the block 10 by tools 36 to sever three sides of the tongue portions 38 from the top wall and rotate the portions down into the block about their bases 48 which remain integrally attached to the top wall. In some applications, the tool may be heated to soften portions 38 and the side walls 18 during staking. In other applications, particularly where the walls are thin, the tongues may be staked by an unheated tool. In either case, the portions of the side walls 16 immediately beneath the staked tongues are displaced and an integral bond in maintained between the tongues and the side walls.

Connectors 26 are confined within non-end cavities 18 by the staked locking tongues 46 which extend from the side walls into the cavities in the path of withdrawal. The tongues are formed of rigid glass filled plastic and are integrally joined to the adjacent side walls and to the top wall, thus providing greater resistance to connector withdrawal than is provided by conventional snap-latch type blocks where the latch is formed of flexible plastic and is deflected from the locking position by insertion of the connector. The side walls support the tongues against collapse toward both wall 14 upon attempted withdrawal of the connectors through openings 24.

Groove 30 is formed in the exterior surface of wall 12 to assure that the staking tool 36 cleanly severs the portion 38 from the top wall 12 when lowered against the block. In this way, the locking tongue is cut from the top wall and moved to the staked position shown in FIG. 4 without undesired cracking of the rigid block because of the high staking forces.

FIGS. 6 thorugh 12 illustrate different configurations of grooves formed in connector block exterior or top walls to facilitate staking of locking tongues similar to tongues 46. The grooves are located on the edges of the tongue portions of the respective blocks.

In FIG. 6 block 60 includes a top wall 62 located above cavities 64 separated by side wall 66. The cavities have open terminal-receiving ends at edge 68. Parallel grooves 70 are located a distance to either side of side wall 66 adjacent block edge 68. The grooves extend nearly through the thickness of top wall 62 to facilitate staking of tongue sections 74.

Following loading of connectors in cavities 64 tools similar to tools 36 are lowered against the tongue portions 76 of top wall 62 located between the adjacent pairs of grooves 70 to sever the ends 78 of these portions from the top wall and break away the sides of the tongue at grooves 70. Further movement of the tool deforms the portions 74 into the interior of the block to form rigid integrally joined locking tongues similar to tongues 46. These tongues are in the path of connector withdrawal and confine the loaded terminals within the block 60.

Figure 10:
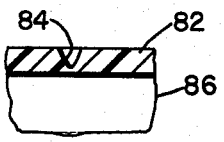

FIGS. 7 and 10 illustrate a connector block 80 similar to blocks 10 and 60 having a top wall 82 with grooves 84 on the exterior surface thereof extending across the side walls 86 separating cavities 88 within the block. Upon loading of connectors into the cavities 88 and lowering of staking tools against tongue portions 90 the portions are cut away from the top wall at grooves 84 and edges 92 are deformed into the interior of the block 80 to form rigid integral locking tongues located in the path of terminal withdrawl to confine the connectors within the cavities.

Figure 11:
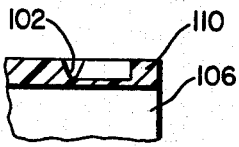
Figure 12:
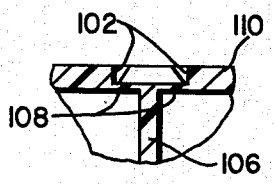

FIGS. 8, 11 and 12 illustrate connector block 100 similar to blocks 10, 60 and 80 wherein U-shaped grooves 102 define staking portions 104 located above side walls 106 between adjacent connector receiving cavities 108. Lowering of staking tools against staking portions 104 breaks these portions away from the top wall 110 and moves them into the interior of the block to form integral rigid locking tongues confining the connectors within the cavities.

The grooves formed in the exterior surface of the top wall of the various disclosed connector blocks reduce the thickness of the top wall to facilitate breaking way of the tongue portions of the block during staking without otherwise injuring the rigid blocks. Grooves extending along the edges of the tongue portions are found particularly desirable as they facilitate breaking away of the edges of the portions from the top wall to assure that the tongue has a maximum width with the result that the sides of the pair of tongues extending into a single cavity are able to withstand high withdrawal forces. The symmetrical location of the grooves with respect to the side wall over which the tongue portion extends assures that the ends and edges of the tongue portions are broken away from the rigid plastic during staking. In this way, the tongue portions are moved into the block as a unit to form the desired rigid integral locking tongues.

As illustrated in FIG. 5, the sides of two tongues 46 extend into each cavity 18 thereby cooperating to confine the connectors 26 within the cavities. This cooperation of locking tongues in each cavity assures that the connectors are retained in the cavities despite the fact that, due to inadvertence or manufacturing error, individual tongue portions may not be properly staked into the block.

Movement of the tongues into the side walls during staking collapses and deforms the parts of the side walls beneath the tongues. While this deformation may destroy part or all of the polymeric bonds between the staked tongues and the side walls, mechanical bonds are formed and integrally join the tongues and side walls.

While I have illustrated and described preferred embodiments of my invention, it is understood that these are capable of modification, and I therefore do not wish to be limited to the precise details set forth, but desire to avail myself of such changes and alterations as fall within the purview of the following claims. Although the invention has been described in connection with blocks for confining connectors in cavities within the blocks, other articles may obviously be confined within the cavities of the blocks so that the invention is not limited to blocks of the type used to house terminals or electrical connectors.

I claim:

1. A block molded of a rigid filled plastic material for receiving connectors or like articles; including an exterior wall; a pair of cavities extending into the block beneath the exterior wall; a side wall between the cavities; and a rigid locking tongue integrally joined to the exterior wall adjacent the cavity open ends and extending away therefrom into both cavities, an integral joint between the tongue and the side wall, the tongue including an end extending into both cavities and blocking withdrawal of connectors or like articles from the cavities.

2. A block as in claim 1 including a series of open ended cavities extending beneath the exterior wall; and a plurality of rigid locking tongues integral with said exterior wall and with said side walls extending into the cavities away from the open cavity ends, each tongue including an end extending into both adjacent cavities and blocking withdrawal of connectors or like articles from such cavities.

3. A block as in claim 2 molded from a glass-filled thermo-plastic material.

4. A rigid block for connectors of like articles molded from a filled thermo-plastic material and including an exterior wall; a pair of cavities extending from one side of the block beneath the exterior wall; a side wall separating said cavities; and a tongue portion on said exterior wall located above said side wall adjacent the open ends of the cavities, the tongue portion extending laterally of the side wall to overlie both cavities, the thickness of the exterior wall being reduced at the periphery of the tongue portion essentially symetrically with respect to the side wall to facilitate staking of the tongue portion to form a rigid locking tongue extending into the side wall and both cavities.

5. A block as in claim 4 including a groove or grooves formed in the exposed surface of the exterior wall at the periphery of the tongue portion.

6. A block as in claim 5 including grooves extending along opposed edges of said tongue portion essentially parallel to and spaced to either side of the side wall.

7. A block as in claim 5 including a groove extending transversely across the side wall.

8. A block as in claim 5 including a U-shaped groove extending around the tongue portion.

* * * * *